United States Patent [19]

Schwarz et al.

[11] 3,992,852

[45] Nov. 23, 1976

[54] ARRANGEMENT FOR PRODUCING FASTENER STRIPS FOR PNEUMATIC NAIL DRIVERS AND THE LIKE

[75] Inventors: Heinz Schwarz, Zizishausen; Heinz Decker, Nurtingen-Oberensingen; Hans Strobl, Tischardt, all of Germany

[73] Assignee: Karl M. Reich Maschinenfabrik, Nuertingen, Germany

[22] Filed: Aug. 1, 1975

[21] Appl. No.: 601,150

[30] Foreign Application Priority Data

Feb. 21, 1975 Germany ..... 2507467

[52] U.S. Cl. ..... 53/196; 156/552; 221/156; 425/110; 425/505

[51] Int. Cl.[2] ..... B65B 13/04

[58] Field of Search ..... 53/3, 196, 200, 140; 198/160; 156/552; 221/156, 171

[56] References Cited

UNITED STATES PATENTS

| | | | |
|---|---|---|---|
| 2,503,518 | 4/1950 | Slaughter | 53/140 X |
| 3,616,083 | 10/1971 | Mohr | 156/552 X |
| 3,729,885 | 5/1973 | Mosetich et al. | 53/3 |

FOREIGN PATENTS OR APPLICATIONS

| | | | |
|---|---|---|---|
| 244,995 | 5/1963 | Australia | 198/60 |

*Primary Examiner*—Travis S. McGehee
*Assistant Examiner*—John Sipos

[57] ABSTRACT

An arrangement is described for assuring a parallel, evenly-spaced relationship among a succession of rod-shaped fasteners, illustratively nails, to be joined by an extruded plastic ribbon and thereafter molded into a nail strip suitable for use in pneumatic nail drivers and the like. A succession of grooves formed in a transfer chain that receives and advances a succession of the nails in a first plane is conventionally contacted by an elongated support means which bears against a first plurality of the grooves on the chain to capture the nails in the grooves. A second pressure member of smaller longitudinal extent than the support member is resiliently mounted in inwardly overlapping relation to the support member adjacent and upstream of the molding portion of the apparatus for contacting the shafts of the captured nails immediately before such nails and the adhered plastic ribbon are molded into the strip. The action of the pressing member serves to maintain the successive captured nails contacted thereby in the desired parallel relationship, so that the required alignment of the successive nails in the finished nail strips is guaranteed.

11 Claims, 5 Drawing Figures

ARRANGEMENT FOR PRODUCING FASTENER STRIPS FOR PNEUMATIC NAIL DRIVERS AND THE LIKE

BACKGROUND OF THE INVENTION

The invention relates to arrangements for forming strips of elongated generally rod-shaped fasteners suitable for use in pneumatic nail drivers and the like. (Such fasteners may generally include nails, screw-nails, screws, pins, studs, and the like; for simplicity, however, such fasteners will be referred to as "nails" throughout the remainder of the specification and claims without in any way limiting the coverage of the invention to such other types of fasteners.)

Such nail strips ideally exhibit a plurality of successive nails maintained in parallel, evenly-spaced relation by an extruded ribbon of plastic material that is molded around the successive nails.

In known arrangements of this type, a conveying apparatus such as a transfer wheel has a plurality of spaced grooves on its periphery for receiving and advancing in a first plane a succession of incoming nails to be incorporated in the finished nail strips. An elongated support member having a first bearing surface that extends over a first number of the successive grooves of the conveying device engages and closes the grooves for capturing the received nails therein. An extruder cooperating with the conveying device advances a plastic ribbon along the shafts of the advancing nails to be adhered thereto, and a molding arrangement disposed downstream of the adhering means and illustratively comprising a pair of cooperating rolls thereupon serves to mold the adhered ribbon about the captured nails to form the required nail strip.

One disadvantage of known arrangements of this type is caused by the unavoidable differences in diameters of the nail shafts captured in the conveying grooves, and/or differences in the depths of the grooves themselves, whereby certain of the nail shafts protrude different distances out of the grooves. The pressure of the elongated support member on the nail shafts along the plurality of grooves contacted thereby will be uneven and will be greatest on the nail shafts protruding farthest beyond the grooves. As a result, the remaining nails then contacted by the support member will be free to move within the grooves during the advancing operation, notwithstanding that such nails remain captured in their respective grooves. The resulting movement of the nails within the grooves as such nails approach the molding portion of the assembly results in a situation where the finished nail strip will have its constituent nails randomly aligned therein.

As a result, when such misaligned nail strips are loaded into magazines to be ultimately introduced into pneumatic nail drivers or other suitable utilization apparatus, they serve to cause jamming and similar malfunctions of such apparatus.

SUMMARY OF THE INVENTION

Such disadvantages are effectively avoided by the arrangement in accordance with the invention for producing nail strips for similar applications.

In an illustrative embodiment, a separate pressure member having a bearing surface that extends over a limited number of grooves significantly less than the number of grooves traversed by the main support member is disposed between the discharge port of the extruder and the effective plane of the molding rolls. The pressure member is resiliently mounted for inward overlapping relation with respect to the inward bearing surface of the support member, whereby the pressure member extends inwardly beyond the grooved area of the conveying member and bears firmly against the shafts of the nails captured in the groove. Since the pressure member operates on at most a few grooves immediately prior to the introduction of the plastic-adhered nails into the molding rolls, the pressure exerted thereby on the shafts of the nails serves to maintain the shafts of the captured nails in the required parallel, evenly-spaced relation as they enter the molding rolls. Accordingly, the molded nail strips exiting from the apparatus exhibit the required alignment.

Illustratively, the supporting means for the pressure member includes a carriage that is supported for reciprocation in a plane transverse to the first plane of movement of the advancing nails. If desired, the main support member may be resiliently secured to the same carriage; in such case, the resilient force applied to the main support member is greater than the force applied to the pressure member. A feature of the invention is the provision of facilities for applying variable tension to the conveying mechanism. Thus, where the conveyor is a transfer chain supported around a pair of spaced chain wheels, one of such wheels can be rotatably supported on a rocker arm pivotable in a plane perpendicular to the first plane, while the other chain wheel is mounted for rotation about a fixed axis. In such a case, a pivoting motion of the rocker arm is effective to vary the tension on the conveyor chain.

In the latter case, a limit switch or other suitable sensor is associated with the rocker arm and is operable to disable the nail-strip-forming apparatus whenever the conveyor chain tension (as measured by the pivoting movement of the rocker arm) exceeds a predetermined value indicative of a jamming of the mechanism.

BRIEF DESCRIPTION OF THE DRAWING

The invention is further set forth in the following detailed description taken in conjunction with the appended drawing; in which.

DETAILED DESCRIPTION

Figure 1:
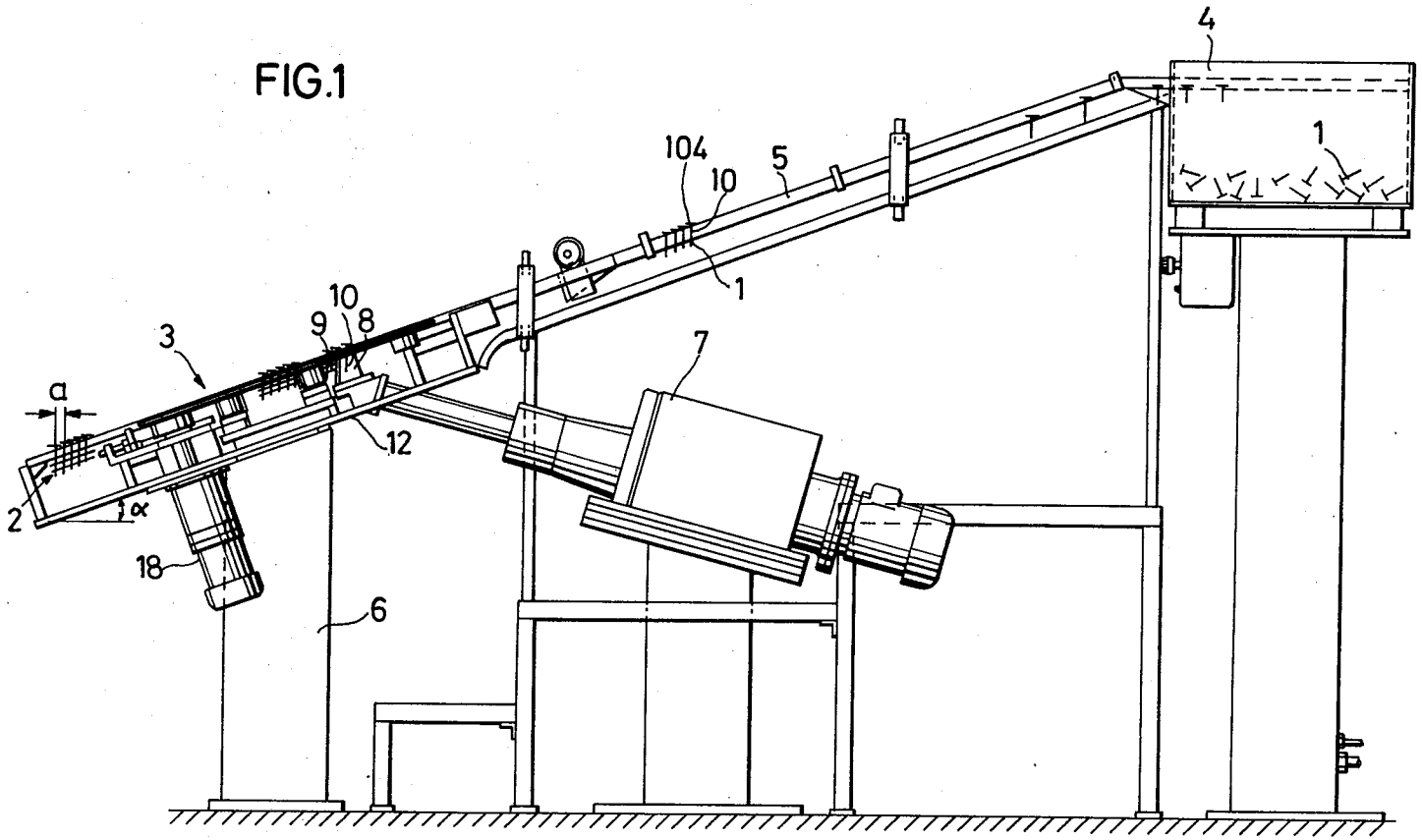
FIG. 1 is an elevation view of an overall nail-strip-forming arrangement having the nail alignment facilities in accordance with the invention.

Referring now to the drawing, an overall nail-strip-forming arrangement having aligning facilities in accordance with the invention includes a suitable vibratory hopper 4 containing a plurality of unaligned nails 1—1. During the vibration of the hopper 4, the nails 1 are conducted into a guide slot 13 (FIG. 3*a*) defined by a pair of guide rails 5—5. The guide rails extend downwardly along a first conveying plane 11 at an angle $\alpha$ to the horizontal, the width of the slot 13 being adjustable by suitable means represented by a handle 103 in FIG.

3*a*. The nails are suspended during their downward travel in the slot 13 by their respective heads (designated 104—104), with the respective shafts of the nails (designated 10—10) extending downwardly through the slot.

Figure 3A:
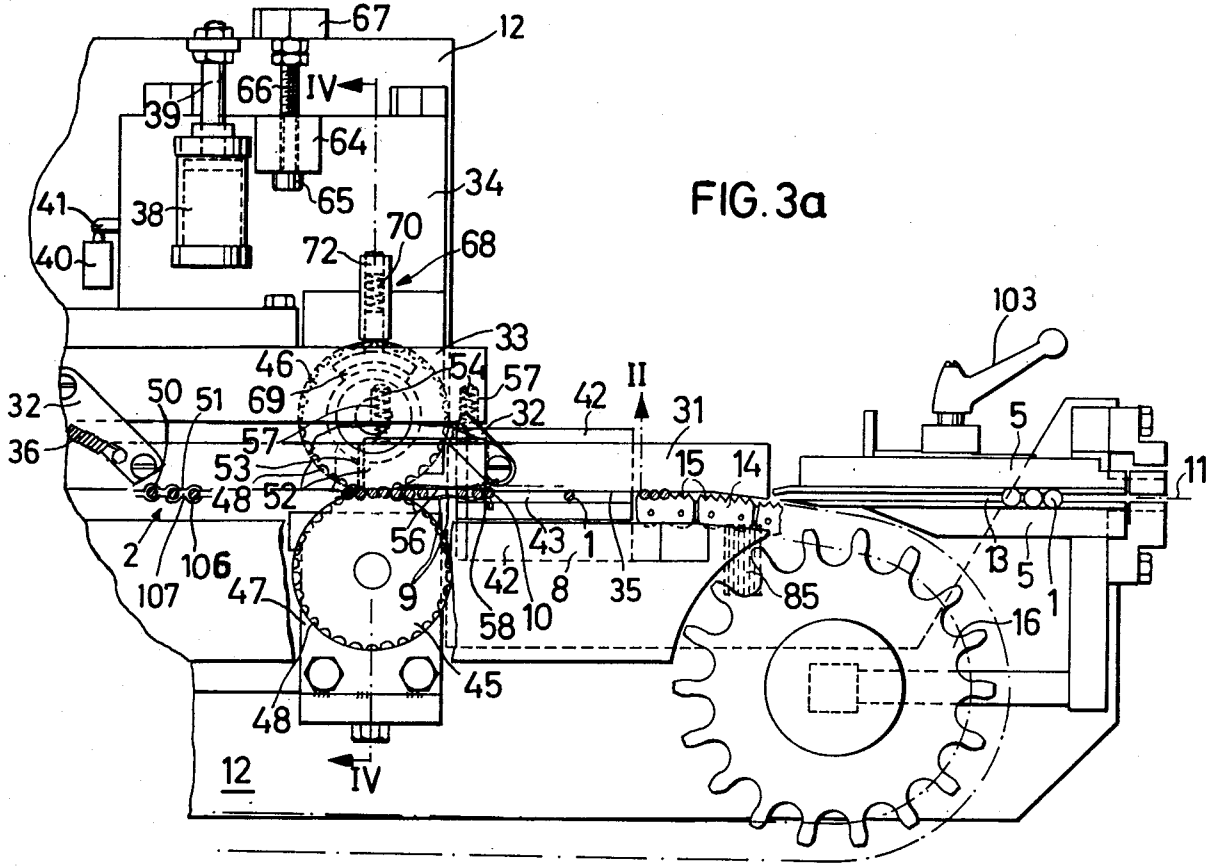
FIGS. 3*a* and 3*b*, taken together, are adjoining views from above of the portion of the nail-strip-forming arrangement delineated by line III—III in FIG. 2 being shown in section in FIG. 3*b;*
Figure 3B:
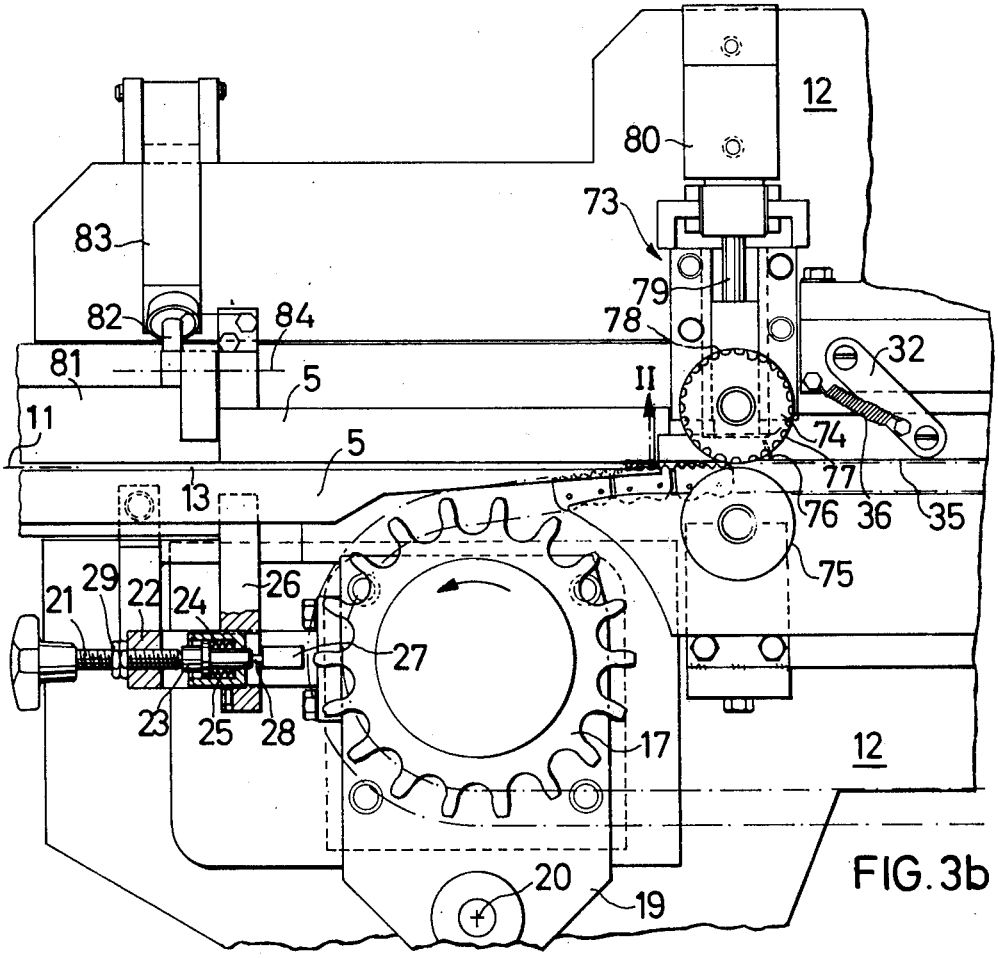

The downstream end of the slot 13 communicates with an input end of a molding arrangement 3, which includes a frame 12 supported on the standard 6. Referring to FIGS. 3*a* and 3*b*, the molding arrangement 3 includes a conveying or transfer chain 14 in communication with the downstream end of the slot 13 for receiving the successive nails 1—1 in a succession of sawtooth-shaped grooves 15—15 of the chain.

The chain 14 extends around a pair of longitudinally spaced chain wheels 16, 17. The wheel 16 is mounted for rotation about a fixed axis in the frame 12. The chain wheel 17 is mounted for rotation by a motor 18 about an axis parallel to the axis of the wheel 16; however, the distance between the wheels 16 and 17 is made adjustable to provide a variable tension on the conveying chain 14 by disposing the wheel 17 on a rocker arm 19 (FIG. 3*b*) mounted, via a pin 20, for pivotal motion on the frame 12 in a plane perpendicular to the plane 11. As indicated below, an excessive tension on the chain 14 tends to pivot the rocker arm 19 in a clockwise direction.

Figure 2:
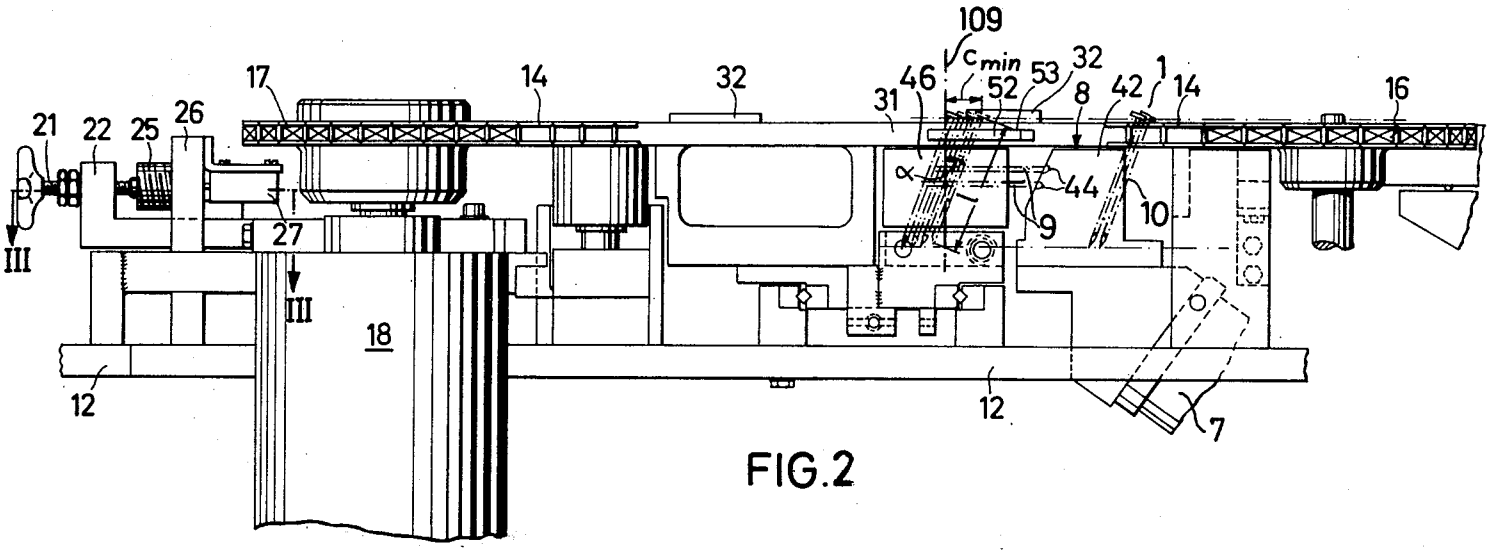
FIG. 2 is a side plan view taken of a portion of the nail-strip-forming arrangement as shown in FIG. 1, partially taken as sectional view along line II—II of FIGS. 3*a* and 3*b;*

Referring to FIG. 2, the nails 1—1 are carried along by the grooves 15 in the conveying chain 14 at the illustrated selected angle $\alpha$. A support member 31 (FIG. 3*a*) bears against the open portion of the grooves 15 in order to capture the successive nails 1 in such grooves during the movement of the chain 14 between the wheels 16, 17.

The support member 31 has a significant longitudinal extent in order to contact a large number of the successive grooves 15. The member 31 has an inner bearing surface 35 adapted to bear against the groove 15. For this purpose, the member 31 is coupled to a carriage 34 which is adapted to reciprocate in a direction transverse to the conveying plane 11 within a V-shaped guide block 37 secured to the frame 12. In particular, a pedestal 33 is attached to the carriage 34, and a plurality of strips 32—32 serve to connect the support member 31 to the pedestal 33. In order to provide a positive inward bearing force of the surface 35 against the grooves 15, a plurality of tension springs 36—36 are associated with each of the strips 32, the restoring force of the springs 36 providing the required urging movement of the surface 35 against the chain grooves.

Referring again to FIG. 2, an extruding apparatus 7 is associated with the molding unit for ejecting at least a pair of plastic strips, via at least a pair of nozzles 44, for adherence to opposite transverse sides of the longitudinally advancing nails. The extruded plastic ribbons, designated as 9—9, together with the succession of nails adhered thereto, are introduced by the conveying chain 14 between a pair of molding rolls 45, 46 (FIG. 3*a*). The rolls 45 and 46 have cooperating semicircular grooves 48—48 for receiving the plastic-adhered nails 1—1 and molding the strips 9—9 around the successive nails to form the finished nail strips (designated 2), in which the succession of nails exiting the rolls 45, 46 are captured and seated in molded plastic jackets having circular portions 106—106 surrounding the nail shafts and separated by linear portions 107—107. The nail strips 2 are severed into equal-length segments by means of a second pair of rolls 74–75, the roll 74 having an associated, conventional severing knife 76 associated therewith.

As shown best in FIG. 3*b*, the output of the severing rolls 74, 75 communicate with an output end of the guide slot 13 defined between the guide rails 5—5. The downstream end of the chain 14, advancing around the pivotable chain wheel 17, advances the severed nail strips into the output portion of the slot 13, which in turn is associated with an ejection section 81 as described below. The severed nail strips are then suitably removed from the overall arrangement of FIG. 1, and stored in cartridges for later use in a conventional pneumatic nail driver or the like.

Figure 4:
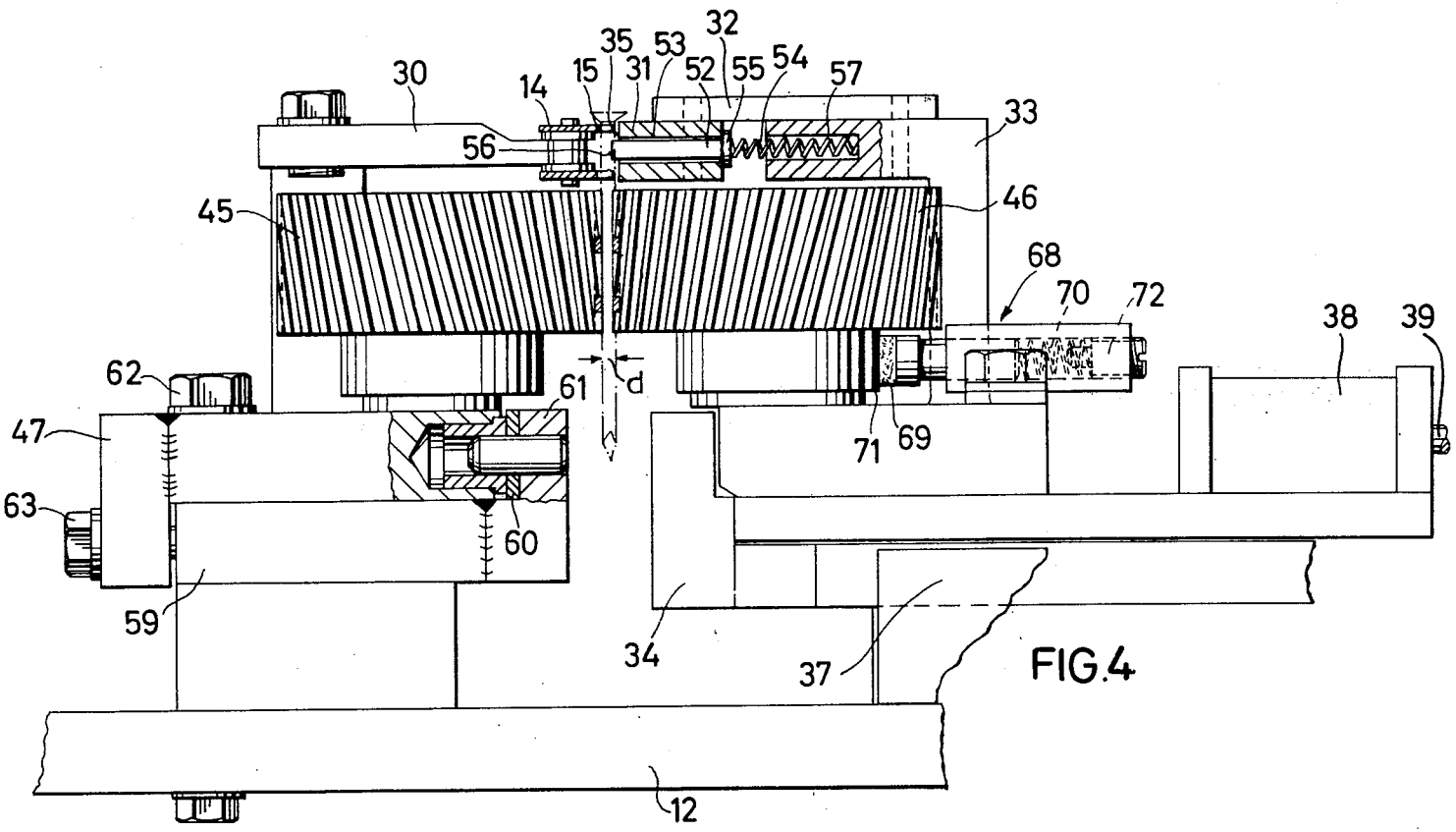
FIG. 4 is a sectional view taken along line IV—IV of FIG. 3*a*.

As indicated above, the bearing surface of the support member 31 extends longitudinally over a large plurality of the successive grooves 15 of the chain 14. Consequently, since the diameter of the shafts of the captured nails 1—1 as well as the depth of the grooves can vary within tolerances, the pressure applied to the support member 31 will be greatest on the captured nails extending farthest out of the grooves, whereby the remaining captured nails are free to move and to relatively misalign themselves within the grooves 15. Consequently, instead of having the nail shafts aligned parallel to each other as indicated in the idealized view shown in FIG. 2, there is the danger that such nail shafts will enter the region of the molding rolls 45, 46 in unaligned relation, so that the finished nail strips 2 will contain similarly misaligned nails and will tend to jaw or otherwise cause malfunctions of the ultimate utilization device, such as the pneumatic nail drivers. To avoid such problem, and as best illustrated in FIG. 4, an additional pressure member 52 is associated with the support member 31 to maintain the nails captured in the grooves 15 in a desired parallel relation prior to their entry into the molding section comprising the rolls 45, 46. The pressure member 52 (FIG. 2) has a longitudinal extent significantly less than that of the pressuure member 31, and as shown is disposed adjacent a central plane 109 of the molding rolls and downstream of the nozzle 44 of the extruding apparatus 7. Such length and positioning of the pressure member 52 assures that each of the nails successively entering the molding portion of the arrangement is subjected to a firm enough force by such member 52 as to prevent its movement out of the illustrated parallel relationship of the several nail shafts. Preferably, as shown in FIG. 2, the distance between the effective central plane of the member 52 and the central plane 109 of the molding rolls is designated $C_{min}$, where $C_{min}$ equals 1x sin $\alpha$ and where 1 equals the length of the nail shaft.

In order to facilitate the imparting of a substantially equal force on each of the captured nails entering the molding rolls 45, 46, the pressure member 52 is urged inwardly toward the central conveying plane with respect to the member 31 by means of a pair of springs 54—54 (FIG. 3*a*) seated in the pedestal 33 of the carriage 34. An inner bearing surface 56 of the pressure member 52 is arranged to inwardly overlap the corresponding inner bearing surface 35 of the support member 31, with the pressure member being located so as to extend inwardly past the stringer of the conveying chain 14, whereby the surface 56 is free to engage and press against the side of the nail shafts 10 captured in the groove 15 by means of the support member 31.

Illustratively, the stringer of the chain 14 has two vertically separated portions, with the support member 31 being connected by means of strips 32—32 to the pedestal 33 so as to engage the corresponding grooves 15 in the upper and lower portions of the chain. In such a case, the pressure member 52, having an enlarged rear portion 55, extends in a central rectangular opening 53 disposed through the support member 31 and the enlarged portion 55 thereof abuts against the support member 31.

It is desired that the restoring force of the spring 54 operating on the pressure member 52 be less than the restoring force of the tension spring 36 (FIG. 3*a*) operating on the pressure member 31.

In order to permit separation of the roll 46 from the roll 45 sufficient to render the captured nail strips accessible in the event of jamming and other disturbances, the roll 46 is supported for transverse reciprocation on the carriage 34. In order to provide the required transverse movement, a piston 39 (FIG. 3*a*) of a piston-cylinder set 38 is secured to the frame 12, while the cylinder is secured to the carriage 34. A microswitch 40 is mounted on the frame 12 and is adapted to be operated by means of a catch member 41 of the carriage 34 when the carriage 34 has been moved by hand against the conveying plane 11. In response to the activation of the microswitch 40, air is suitably introduced into the cylinder 38 to press the carriage 34 with full force toward the plane 11 until a catch 64 on the carriage engages head 65 of a screw 66. The screw 66 is adjustably threaded into a pedestal 67 associated with the frame 12 to preset a desired distance between the roll 46 and the plane 11.

The molding roll 45 is mounted in a support pedestal 59 attached to the frame 12. A removable spacer 60 is provided in the pedestal 59 to locate the roll 45 in a proper transverse position relative to the movable roll 46 to accommodate the nominal diameter *d* of the nail shafts 10.

The severing rolls 74, 74 are arranged for transverse relative movement to permit separation of the rolls sufficient to render the nail strips accessible in case of jamming and other disturbances. For this purpose, the roll 75 is mounted for rotation about a fixed axis in the frame 12, while the roll 74 is supported on a carriage 78 for reciprocation in a direction transverse to the conveying plane 11. A second piston-cylinder set 80, suitably driven can be actuated to impart the required reciprocatory motion to the carriage 78.

The ejection flap 81 associated with one of the guide rails 5 at the output of the nail-strip-forming arrangement is pivotable toward and away from the other guide rail 5 to facilitate removal of improperly manufactured nail strips from the output portion of the guide slot 13. The movement of the flap 81 is facilitated by means of a third piston-cylinder set 83 connected between the flap and the frame 12.

A microswitch 27 having a trigger pin 28 is mounted on a flange 26 which in turn is fixedly secured to the frame 12. A handle 22 is affixed to the rocker arm 19 for movement to the right as viewed in the figure when the chain 14 is excessively tensioned, because of the above-mentioned pivotal movement of the rocker arm 19 in a clockwise direction. The degree of movement of the rocker arm 19 to actuate a trigger pin 28 of the microswitch 27 can be adjustably set by a tensioning screw 21, which is carried in the handle 22 to bear against a spring-loaded stud 23. The stud 23 is disposed in a housing 25 that is threadedly secured to the flange 26 and extends therefrom to contact the trigger pin 28 of the limit switch 27.

Consequently, when the rocker arm is pivoted clockwise in response to an increase in chain tension, the corresponding rightward movement of the screw 21 operates the switch 27 over stud 23. By turning in the threaded adjustment screw 21 a predetermined amount, and locking it via a lock nut 29, a corresponding degree of tension of the conveying chain 14 indicative, e.g. of jamming of the conveying chain caused by bent nails and the like, can be preset before the microswitch 27 is actuated. The latter, in turn, may be operatively coupled to a main switch (not shown) to disable the apparatus.

Referring again to FIG. 4, the inward urging force provided by the springs 54 on the back element 55 of the pressure member 52 serves to maintain the pressure member 52 in its desired position in inwardly overlapping relation to the bearing surface 35 of the support member 31. The distance $C_{min}$ between the central plane of such member 52 and the central plane 109 (FIG. 2) of the molding rolls is advantageously selected to be approximately ten times the central distance *a* (FIG. 1) between the shafts of adjacent nails in the nail strip.

As noted from FIG. 4, the rolls 45, 46 are not independently driven but are rotated when the succession of nails 1—1 captured in the grooves 15 enter the grooves 48 of the rolls. In order to prevent uncontrolled rotations of the freely supported rolls 45, 46, a braking arrangement 68 is mounted on the carriage 34 and associated with the roll 46 for providing a controlled retardation of the rotation of such roll. For this purpose, the assembly 68 includes an arcuate braking surface 69 (FIG. 3*a*) which bears against a flange 71 of the roll 46, such braking surface 69 being supported resiliently within the assembly 68 by means of a spring 70.

Preferably, the electric motor 18 for the chain 14 and the drive motor for the extruder 7 are actuated by means of a common switch (not shown). Simultaneously, the cylinder-piston-unit 80 associated with the separation arrangement 73, and the piston-cylinder set 83 associated with the throw-out flap 81, may be placed under pressure by means of an electropneumatic valve (not shown).

The operation of the above-described apparatus is as follows:

After the operation of a key switch (not shown) for the control of the cylinder-piston set 38, carriage 34 is pushed by hand against the conveying chain 14, until the catch 41 operates the limit switch 40. At this point, air pressure is introduced into the cylinder-piston set 38 to drive the catch 64 of carriage 34 firmly against the screw head 65 in the direction of the chain 14. When this occurs, the guiding surface 35 of the support member 31 is applied with a predetermined pressure against toothed surface of the chain 14, while the surface 56 of the pressure element 52 extends in overlapping relation to the guiding surface 35 between the upper and lower rows of the chain 14.

The shafts 10 of the incoming nails 1 from the guide slot 13 are pulled into the successive grooves 15 by means of an electro-magnet 85 arranged at the end of the guide rail 5. The guiding surfaces 35 of the support member 31 not hold the shafts 10 loosely in the grooves 15, until such shafts reach the inclined surface 58 of the overlapping pressure element 52. The inclined surface 58 cams the shafts firmly into the grooves 15, and the member 52 now holds such shafts parallel to each other in the conveying plane 11.

The extruder 7 delivers a pair of the support strips 9 to both sides of the nail shaft 10 via nozzles 44, so that the strips are carried along by the advancing shafts. The grooves 48 of the rolls 45, 46, shape the support strips 9 as indicated above to capture the nails therein and form the nail strips 2. Such strips are separated into definite-length segments by means of the knife 76 of the separation arrangement 73, which segments are then removed at the end of the molding arrangement. If the chain 14 is squeezed or jammed by means of a bent or otherwise unusable nail, the rocker arm 19 attempts to pivot in the clockwise direction as indicated above. Such motion, transmitted through the handle 22, tension screw 21, and pin 23 actuates the trigger pin 28 of the limit switch 27. Such switch thereupon actuates a main switch (not shown) to disable the apparatus; this is accomplished, e.g., by switching off the electric motor 18 of the chain 14 and the drive for the extruder, and by so operating the valve for the cylinder-piston set 80 associated with the separation arrangement 73 and the piston-cylinder set 83 associated with the throw-out flap 81, that the roll 74 is pulled away from the chain 14 and the throw-out flap 81 is simultaneously oscillated back out of the plane of the guide rail 5. Also, after the operation of an additional key switch (not shown) that operates the cylinder-piston set 38 of the carriage 34, such set 38 is ventilated so that the carriage 34 can be moved away easily by hand from the chain 14. With these operations, the nail strip is made freely accessible over its entire length so that the defective piece can be quickly and conveniently removed.

In the foregoing, the invention has been described in connection with an illustrative embodiment thereof. Many variations and modifications will now occur to those skilled in the art. It is accordingly desired that the scope of the appended claims not be limited to the specific disclosure herein contained.

What is claimed is:

1. In an arrangement for producing nail strips which includes conveying means having a succession of spaced grooves for receiving and advancing, in a first plane, a succession of incoming nails in spaced relation, an elongated support member having a first bearing surface extending over a first member of successive grooves of the conveying means for capturing the nails received in said number of grooves, means for contacting the shafts of the successive captured nails with at least one plastic ribbon, and means disposed downstream of the contacting means for molding the adhered ribbon about the captured nails to form a nail strip, the improvement which comprises, in combination, a pressure member having a second bearing surface extending over a second number of grooves of the conveying means and disposed adjacent the molding means and downstream of the contacting means, the second number of grooves being less than the first number of grooves, and means for resiliently supporting the pressure member with the second bearing surface in inwardly overlapping relation with respect to the first bearing surface of the support member for contacting the shafts of the adhered nails captured in the second number of grooves.

2. An arrangement as defined in claim 1, in which the pressure member supporting means comprises, in combination, a carriage mounted for movement toward and away from the first plane, means for coupling the pressure member to the carriage, and first means associated with the last-mentioned coupling means for urging the pressure member towards the first plane.

3. An arrangement as defined in claim 2, further comprising means for mounting the support member on the carriage, and second means associated with the last-mentioned mounting means for urging the support member in the direction of the first plane.

4. An arrangement as defined in claim 3, in which the force of the first urging means is less than the force of the second urging means.

5. An arrangement as defined in claim 2, further comprising normally disabled means for driving the carriage in a direction toward the first plane, a limit switch associated with the carriage, means for operating the limit switch when the carriage is pre-positioned in said direction into contact with the first plane, and means responsive to the operation of the limit switch for energizing the carriage driving means.

6. An arrangement as defined in claim 2, in which the molding means comprises first and second cooperating rolls having grooved peripheries for receiving the shafts of the captured nails, and in which the arrangement further comprises means for supporting one of the first and second rolls for rotation on the carriage.

7. An arrangement as defined in claim 6, further comprising braking means for retarding the motion of one of the first and second rolls.

8. An arragement as defined in claim 1, in which the conveying means comprises a grooved transfer chain extending the first plane, and in which the arrangement further comprises, in combination, first and second chain wheels disposed in spaced relation and carrying the transfer chain, and means operating on at least one of the first and second chain wheels for applying a variable tension to the transfer chain.

9. An arrangement as defined in claim 8, in which the arrangement further comprises, in combination, means for mounting the first chain wheel for rotation about a first axis, a rocker arm pivotable in a second plane perpendicular to the first plane, and means mounting the second chain wheel on the rocker arm for rotation about an axis parallel to the first axis; and in which the tension varying means comprises means for pivoting the rocker arm in the second plane.

10. An arrangement as defined in claim 9, in which the arrangement further comprises, in combination, a limit switch, and means rendered effective when the rocker arm has moved past a predetermined position in the tension-increasing direction for operating the limit switch.

11. An arrangement as defined in claim 6, further comprising means for supporting said one of the first and second rolls for movement toward and away from the first plane.

* * * * *